US008185005B2

(12) United States Patent
Murayama

(10) Patent No.: US 8,185,005 B2
(45) Date of Patent: May 22, 2012

(54) IMAGE FORMING APPARATUS

(75) Inventor: Kentaro Murayama, Kasugai (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 381 days.

(21) Appl. No.: 12/563,714

(22) Filed: Sep. 21, 2009

(65) Prior Publication Data

US 2010/0074638 A1 Mar. 25, 2010

(30) Foreign Application Priority Data

Sep. 25, 2008 (JP) ..... 2008-245877

(51) Int. Cl.
*G03G 15/00* (2006.01)
*G03G 21/16* (2006.01)

(52) U.S. Cl. ..... 399/49; 399/45; 399/72; 399/301

(58) Field of Classification Search ..... 399/45–49, 399/72, 299, 301
See application file for complete search history.

(56) References Cited

U.S. PATENT DOCUMENTS

| | | | | |
|---|---|---|---|---|
| 5,510,877 | A * | 4/1996 | deJong et al. | 399/38 |
| 5,825,984 | A | 10/1998 | Mori et al. | |
| 5,872,586 | A | 2/1999 | Shio | |
| 2005/0031361 | A1 * | 2/2005 | Kobayashi | 399/49 |
| 2008/0226361 | A1 * | 9/2008 | Tomita et al. | 399/301 |

FOREIGN PATENT DOCUMENTS

| | | | |
|---|---|---|---|
| JP | 04-350677 | | 12/1992 |
| JP | 8-305110 | A | 11/1996 |
| JP | 9-204087 | A | 8/1997 |
| JP | 10-003188 | | 1/1998 |
| JP | 2000-284561 | | 10/2000 |
| JP | 2001-228679 | A | 8/2001 |
| JP | 2005-018094 | A | 1/2005 |
| JP | 2005-346094 | | 12/2005 |

OTHER PUBLICATIONS

JP Office Action dtd Apr. 14, 2011, JP Appln. 2008-245877, partial English translation.
JP Office Action dtd Aug. 7, 2010, JP Appln. 2008-245877, partial English translation.

* cited by examiner

*Primary Examiner* — David Porta
*Assistant Examiner* — Jessica L Eley
(74) *Attorney, Agent, or Firm* — Banner & Witcoff, Ltd.

(57) ABSTRACT

An image forming apparatus including an image carrier, a plurality of forming devices, a detecting device configured to perform a steady-deviation detection for detecting steady positional deviation and a varying-deviation detection for detecting varying positional deviation having a cycle, and a correcting device configured to perform a steady-deviation correction for correcting the steady positional deviation and a varying-deviation correction for correcting the varying positional deviation. The detecting device forms, during the steady-deviation detection, a steady-deviation detection pattern in a state where the varying deviation correction is selectively disabled. The steady-deviation detection pattern has a plurality of measuring points arranged in a longitudinal direction. The detecting device, during the steady-deviation detection, measures positional deviation amount at each measuring point, and detects the steady positional deviation based on the measurement result.

6 Claims, 9 Drawing Sheets

IMAGE FORMING APPARATUS

CROSS REFERENCE TO RELATED APPLICATION

This application claims priority from Japanese Patent Application No. 2008-245877 filed on Sep. 25, 2008. The entire content of this priority application is incorporated herein by reference.

TECHNICAL FIELD

The present invention relates to image forming apparatuses or, more specifically, to an image forming apparatus that includes a function for detecting positional deviation of an image to be formed and correcting the deviation.

BACKGROUND

An image forming apparatus of a tandem type is conventionally provided, which includes a plurality of image forming units arranged along a sheet conveying belt. The image forming units sequentially transfer toner images of respective colors to the sheet on the belt. In order to ensure image quality, a technique referred to as "registration" has been adopted to such apparatuses. In this technique, positional deviation of images is detected and corrected.

For example, a known image forming apparatus includes a function to detect and correct steady positional deviation due to misalignment of components of image forming units (photosensitive drums, optical members of exposure units, etc.), or the like. The apparatus includes also a function to detect and correct varying positional deviation having one or more cycles due to eccentricities of the photosensitive drums or belt supporting rollers, gear pitch errors of gears for driving these members, or the like. During one of these functions being performed, a pattern having a plurality of marks of respective colors is formed on the belt by the image forming units. The positions of the marks are measured by an optical sensor, and their deviation amounts from respective ideal positions are detected. Then, based on the detection result, the deviation of an image to be formed of each color is corrected.

During the detection of the steady positional deviation being performed, the pattern is conventionally formed on the belt in a state where the varying positional deviation is corrected, and then the pattern is measured.

However, the accuracy in the steady-deviation detection may deteriorate due to errors contained in the detection and/or correction of the varying positional deviation.

Therefore, there is a need for an image forming apparatus that can ensure the accuracy in the steady-deviation detection.

SUMMARY

An aspect of the present invention is an image forming apparatus including: an image carrier; a plurality of forming devices configured to form an image; a detecting device configured to perform a steady-deviation detection and a varying-deviation detection, the steady-deviation detection being for detecting steady positional deviation of an image to be formed by the plurality of forming devices, the varying-deviation detection being for detecting varying positional deviation of the image, the varying positional deviation having a cycle; and a correcting device configured to perform a steady-deviation correction and a varying-deviation correction, and selectively enable or disable the varying-deviation correction, the steady-deviation correction being for correcting the steady positional deviation based on the result of the steady-deviation detection, the varying-deviation correction being for correcting the varying positional deviation based on the result of the varying-deviation detection, wherein: the detecting device forms, during the steady-deviation detection, a steady-deviation detection pattern on the image carrier using the plurality of forming devices in a state where the varying deviation correction is disabled; the steady-deviation detection pattern has a plurality of measuring points arranged in a longitudinal direction; and the detecting device, during the steady-deviation detection, measures positional deviation amount at each measuring point, and detects the steady positional deviation based on the measurement result.

DETAILED DESCRIPTION

An illustrative aspect in accordance with the present invention will be described with reference to FIG. 1 through FIG. 9.

1. Schematic Configuration of Printer

Figure 1:
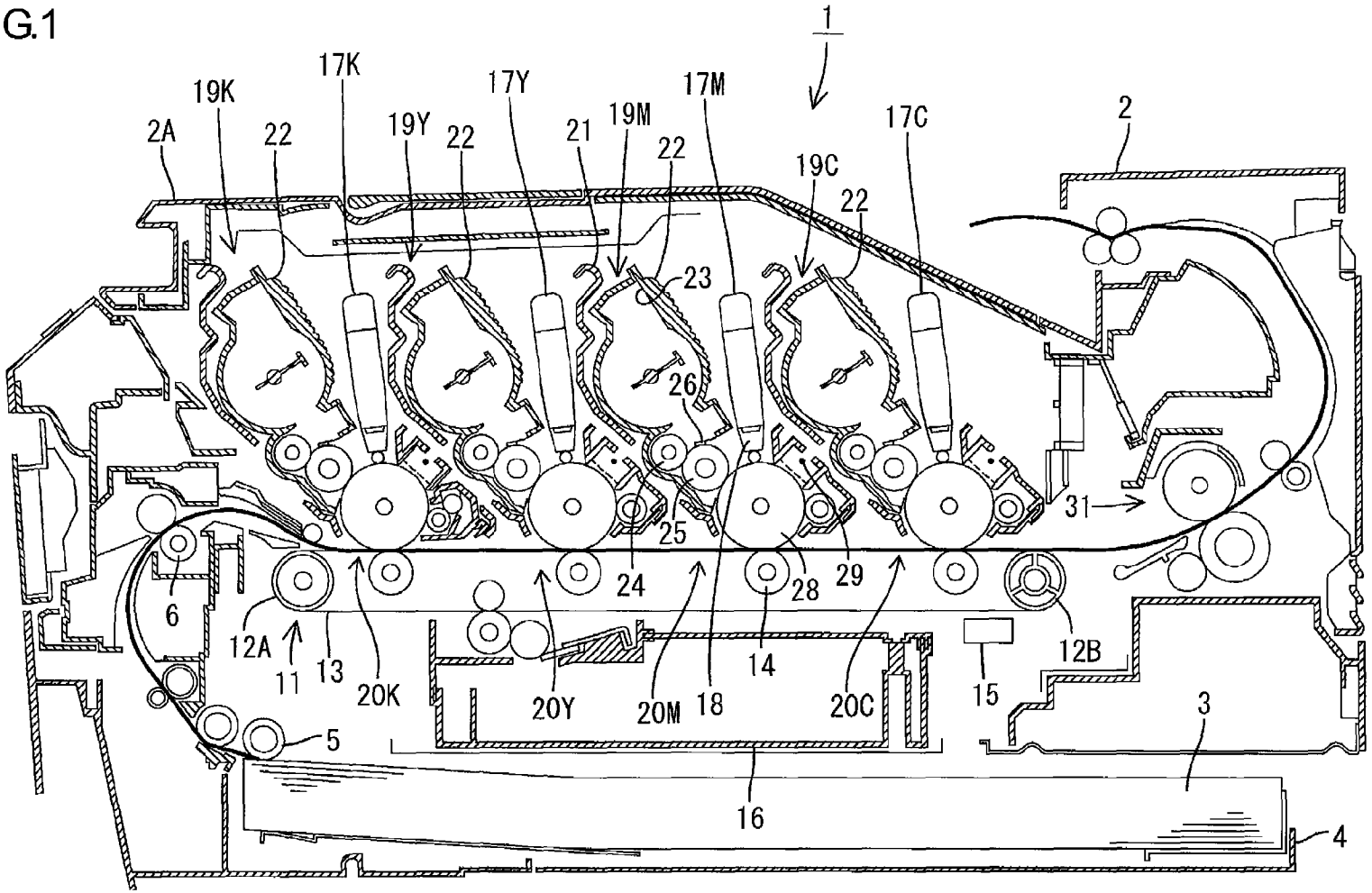
FIG. 1 is a side sectional view illustrating a schematic configuration of a printer of an illustrative aspect in accordance with the present invention.

FIG. 1 is a side sectional view illustrating a schematic configuration of a printer 1 (an illustration of an image forming apparatus). The printer 1 is a direct tandem type color printer that can form images using toner of four colors (such as black K, yellow Y, magenta M, and cyan C). The left side in FIG. 1 represents the front side of the printer 1. In FIG. 1, some reference characters of identical components in different colors are omitted.

The printer 1 includes a body casing 2 and an openable cover 2A disposed on the top of the body casing 2. Inside the lower part of the body casing 2, a feed tray 4 is provided for stacking a plurality of sheets 3 (each is an illustration of a recording medium). A feed roller 5 is disposed above the front side of the feed tray 4. As the feed roller 5 rotates, the sheet 3 stacked uppermost in the feed tray 4 is sent out toward a registration roller pair 6. The registration roller pair 6 corrects skew of the sheet 3 and conveys the sheet 3 onto a belt unit 11.

The belt unit 11 includes a belt support roller 12A disposed at the front side thereof, a belt drive roller 12B disposed at the rear side thereof, and a continuous loop belt 13 (an illustration of an image carrier) stretched between these rollers 12A, 12B. The belt 13 can be made of resin such as polycarbonate. Transfer rollers 14 are disposed in the loop of the belt 13 each at positions opposed to respective photosensitive drums 28 of process units 19K-19C (described below) via the belt 13. When the cover 2A of the body casing 2 is open and the process units 19K-19C are removed, the belt unit 11 can be removed from, and attached to, the body casing 2.

When the belt unit 11 is attached to the body casing 2, the belt drive roller 12B is connected to a drive motor 47 (see FIG. 2) via a gear mechanism (not illustrated). During the drive motor 47 drives the belt drive roller 12B, the belt 13 circulates in a clockwise direction in the figure. Thereby, the sheet 3, which is electrostatically adsorbed on an upper surface of the belt 13, is conveyed rearwardly.

Below the belt 13, a pattern detection sensor 15 is disposed for detecting a pattern and the like formed on the surface of the belt 13. The sensor 15 includes a light-emitting circuit which emits light to the surface of the belt 13 and a light-receiving circuit which receives the reflected light with a photodiode and outputs an electric signal corresponding to the intensity of the received light. A cleaning unit 16 is also disposed below the belt unit 11. The cleaning unit 16 can collect toner, paper powder, and the like adhered to the surface of the belt 13.

Above the belt unit 11, exposure units 17K, 17Y, 17M, 17C and the process units 19K, 19Y, 19M, 19C are alternatingly arranged in tandem. The exposure units 17K-17C, the process units 19K-19C, and the transfer rollers 14 configure four sets of image forming units 20K, 20Y, 20M, 20C (an illustration of a plurality of forming devices), which respectively correspond to black, yellow, magenta and cyan colors.

The exposure units 17K-17C are held on a lower surface of the cover 2A. The exposure units 17K-17C include respective LED heads 18 each having a plurality of LEDs arranged in line at the bottom end thereof. The exposure units 17K-17C are controlled based on image data of the corresponding color so that the LED heads 18 emit light line by line to the surfaces of the respective photosensitive drums 28.

Each of the process units 19K-19C includes a cartridge frame 21 and a developer cartridge 22 removably attached to the cartridge frame 21. When the cover 2A is opened, the exposure units 17K-17C are removed upwardly following the cover 2A so as to allow each of the process units 19K-19C to be separately removed from, and attached to, the body casing 2.

The developer cartridge 22 includes a toner chamber 23, a supply roller 24, a developer roller 25, a layer-thickness regulating blade 26, and the like. The toner chamber 23 stores toner (developer) of the corresponding color. Toner released from the toner chamber 23 is supplied to the developer roller 25 by the supply roller 24 and is positively charged by friction between the supply roller 24 and the developer roller 25. Then, as the developer roller 25 rotates, the toner supplied to the developer roller 25 enters between the layer-thickness regulating blade 26 and the developer roller 25. The toner is further charged by friction there and formed into a uniform thin layer.

Each of the cartridge frames 21 holds a photosensitive drum 28 and a charger 29. The photosensitive drum 28 has a surface covered with a photosensitive layer having a positive charge property. During image formation, as the photosensitive drum 28 rotates, the charger 29 uniformly and positively charges the surface of the photosensitive drum 28. Then, the exposure unit 17K-17C scans the positively charged surface to expose it. Thus, an electrostatic latent image is formed on the surface of the photosensitive drum 28.

Next, the developer roller 25 supplies the positively charged toner to the electrostatic latent image on the surface of the photosensitive drum 28, so that the electrostatic latent image is visualized as a toner image. While the sheet 3 passes between each photosensitive drum 28 and the corresponding transfer roller 14, the toner images carried on the surfaces of the photosensitive drums 28 are sequentially transferred onto the sheet 3 under the negative transfer voltage applied to the transfer rollers 14. Next, the sheet 3 carrying the transferred toner images is conveyed to a fixing unit 31, where the toner image is thermally fixed. Thereafter, the sheet 3 is conveyed upwardly and ejected onto a top surface of the cover 2A.

2. Electrical Configuration of Printer

Figure 2:
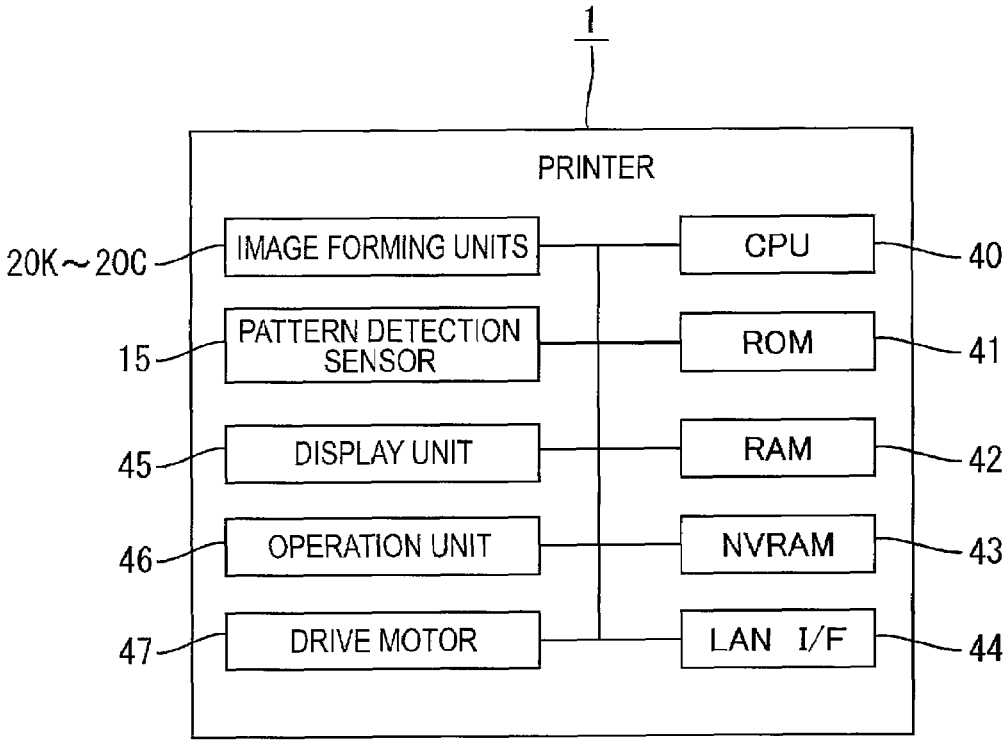
FIG. 2 is a block diagram schematically illustrating an electrical configuration of the printer.

FIG. 2 is a block diagram schematically illustrating an electrical configuration of the printer 1.

As illustrated in FIG. 2, the printer 1 includes a CPU 40 (an illustration of a detecting device and a correcting device), a ROM 41, a RAM 42, a NVRAM (nonvolatile random access memory) 43, and a network interface 44. These members are connected to the above-described image forming units 20K-20C, the pattern detection sensor 15, a display unit 45, an operation unit 46, the drive motor 47, and the like.

The ROM 41 stores various programs for controlling the operation of the printer 1, such as execution of detection processes (described below) and the like. The CPU 40 reads out these programs from the ROM 41 and, according to the programs, controls each component of the printer 1 while storing results of the processes in the RAM 42 and/or the NVRAM 43. The network interface 44 is connected to an external computer (not illustrated) via a communication line such that mutual data communication is available.

The display unit 45 can include a liquid crystal display, indicator lamps. Thereby, various setting screens, operating states of the printer 1, and the like can be displayed. The operation unit 46 includes a plurality of buttons so that a user can perform various input operations. The drive motor 47 can drive the registration roller pair 6, the belt drive roller 12B, the developer rollers 25, and the photosensitive drums 28 via a gear mechanism (not illustrated).

3. Operation of Printer

During image formation, the CPU 40 can perform steady-deviation correction, varying-deviation correction, and density-deviation correction. The steady-deviation correction is for correcting steady positional deviation of images to be formed by the image forming units 20K-20C. The varying-deviation correction is for correcting varying positional deviation, which has one or more particular cycles, of the images to be formed. The density-deviation correction is for correcting density deviation of the images to be formed. Furthermore, the CPU 40 can selectively enable or disable each correction.

These three types of corrections are performed based on, respectively, steady-deviation correction values, varying-deviation correction values, and density-deviation correction values, all of which are stored in the NVRAM 43. Furthermore, the CPU 40 can perform steady-deviation detection, varying-deviation detection, and density-deviation detection. The steady-deviation detection is performed by measuring amounts of the steady positional deviation and, based on the amounts, updating the steady-deviation correction values. The varying-deviation detection is performed by measuring amounts of the varying positional deviation and, based on the amounts, updating the varying-deviation correction values. The density-deviation detection is performed by measuring amounts of the density deviation and, based on the amounts, updating the density-deviation correction values.

These detection processes are executed under control of the CPU 40 when a predetermined condition is met, e.g. when the main power is turned on, when open-close of the cover 2A is detected, when removal or attachment of the process units 19K-19C or the belt unit 11 is detected, or when a predetermined period of time has elapsed or a predetermined number of sheets are printed since a previous detection process has been executed.

(Varying-Deviation Detection Process)

Figure 3:
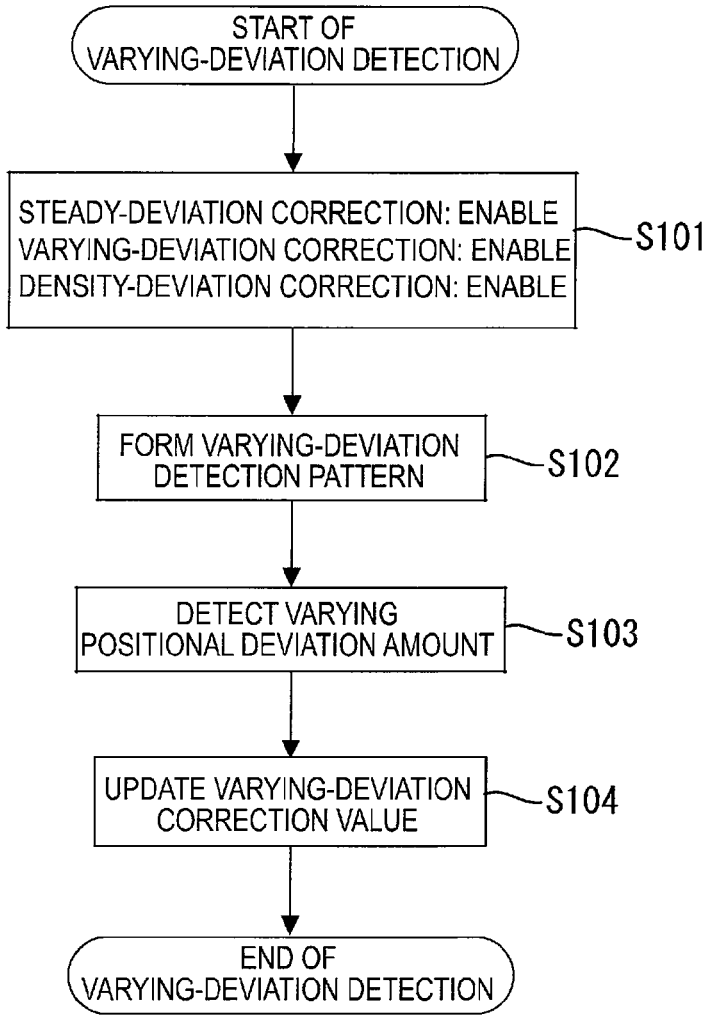
FIG. 3 is a flowchart illustrating a varying-deviation detection process.
Figure 4:
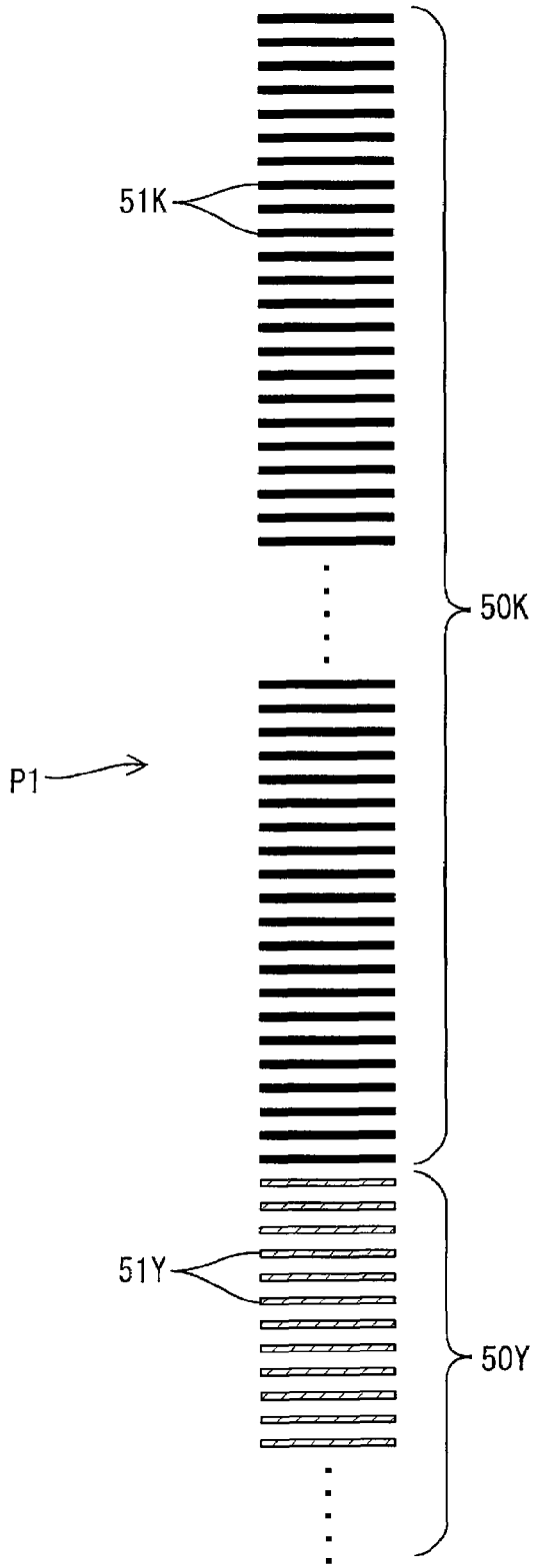
FIG. 4 is an illustration of a varying-deviation detection pattern.

FIG. 3 is a flowchart illustrating a varying-deviation detection process. FIG. 4 is an illustration of a varying-deviation detection pattern P1.

As illustrated in FIG. 3, during the varying-deviation detection process, the CPU 40 enables the steady-deviation correction, the varying-deviation correction, and the density-deviation correction (S101). Then, the CPU 40 forms a varying-deviation detection pattern P1 on the belt 13 using the image forming units 20K-20C (S102). In this step, the CPU 40 reads out the steady-deviation correction values, the varying-deviation correction values, and the density-deviation correction values from the NVRAM 43. Then, the CPU 40 produces image data of the pattern P1, which includes density data and scan start timing data of each scan line. In producing the image data of the pattern P1, the CPU 40 corrects the density data based on the density-deviation correction values and, further, corrects the scan start timing data of each scan line based on the steady-deviation correction values and the varying-deviation correction values. Then, the CPU 40 supplies the image data to the exposure units 17K-17C. Thus, the varying-deviation detection pattern P1 is formed in a state where the steady positional deviation, the varying positional deviation, and the density deviation have been corrected.

As illustrated in FIG. 4, the varying-deviation detection pattern P1 includes a plurality of mark groups 50K, 50Y for each color. Each of the mark groups 50K, 50Y consists of a predetermined number of same color marks 51K, 51Y (in FIG. 4, only black marks 51K of mark group 50K and yellow marks 51Y of mark group 50Y are illustrated). Each of the marks 51K, 51Y is elongated in the main scanning direction (i.e., the widthwise direction of the belt 13). The marks 51K, 51Y are arranged at intervals in the vertical scanning direction (i.e., the moving direction of the belt 13). When the marks 51K, 51Y are formed at respective ideal positions without any positional deviation, the intervals between adjacent marks 51K, 51Y in each mark group 50K, 50Y become equal. In addition, a length of each of the mark groups 50K, 50Y in the vertical scanning direction is at least equal to, preferably greater than, the circumferential length of the photosensitive drum 28. More preferably, the length is equal to an integral multiple of the circumferential length of the photosensitive drum 28.

Next, while the marks 51K, 51Y formed on the belt 13 pass the detection area of the pattern detection sensor 15 at respective time points, the CPU 40 measures the time points by the signal received from the sensor 15. Then, based on the measurement result, the CPU 40 detects amounts of varying positional deviation of each color, for example, which has a cycle corresponding to the rotational period of the photosensitive drum 28 (S103). More specifically, the CPU 40 divides the cycle into a plurality of sections and, for each section, calculates deviation amounts of the corresponding marks 51K (51Y) from the respective ideal positions. Then the CPU 40 calculates the average value of the deviation amounts for each section, and sets the average value as a varying positional deviation amount for the section. Next, the CPU 40 calculates a correction value that compensates for the varying positional deviation amount for each section, and adds the correction value to the varying-deviation correction value (stored in the NVRAM 43) corresponding to the section. The CPU 40 thus updates the varying-deviation correction values (S104). Thereafter, the CPU 40 completes the varying-deviation detection process.

(Steady-Deviation Detection Process)

Figure 5:
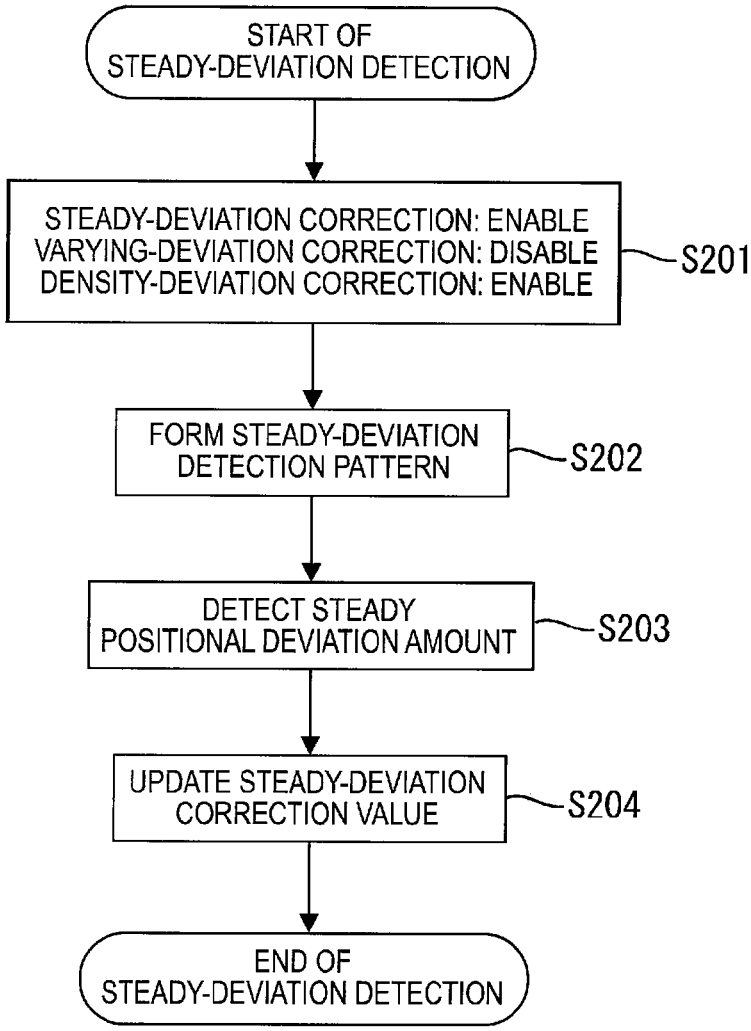
FIG. 5 is a flowchart illustrating a steady-deviation detection process.
Figure 6:
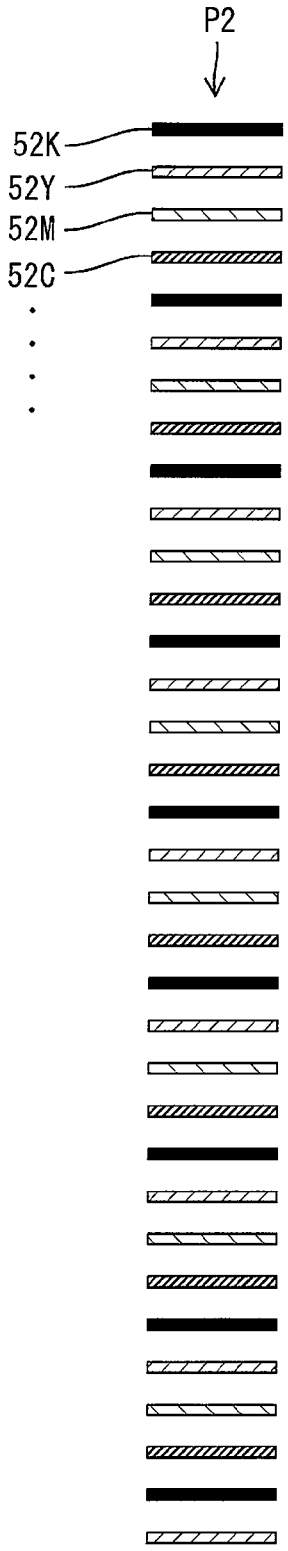
FIG. 6 is an illustration of a steady-deviation detection pattern.

FIG. 5 is a flowchart illustrating a steady-deviation detection process. FIG. 6 is an illustration of a steady-deviation detection pattern P2.

As illustrated in FIG. 5, during the steady-deviation detection process, the CPU 40 enables the steady-deviation correction and the density-deviation correction, and disables the varying-deviation correction (S201). Then, the CPU 40 forms a steady-deviation detection pattern P2 on the belt 13 using the image forming units 20K-20C (S202). In this step, the CPU 40 reads out the steady-deviation correction values and the density-deviation correction values from the NVRAM 43. Then, the CPU 40 produces image data of the pattern P2, which includes density data and scan start timing data of each scan line. In producing the image data of the pattern P2, the CPU 40 corrects the density data based on the density-deviation correction values and, further, corrects the scan start timing data based on the steady-deviation correction values. Then, the CPU 40 supplies the image data of the pattern P2 to the exposure units 17K-17C. That is, in this process, the varying-deviation correction values stored in the NVRAM 43 is not read out, and the varying-deviation correction is not performed. Thus, the steady-deviation detection pattern P2 is formed in a state where the steady positional deviation and the density deviation have been corrected.

As illustrated in FIG. 6, the steady-deviation detection pattern P2 includes a plurality of mark sets, each of which consists of four different color marks 52K, 52Y, 52M, 52C (black, yellow, magenta, and cyan, arranged in that order). Each of the marks 52K, 52Y, 52M, 52C is elongated in the main scanning direction. The marks 52K-52C (an illustration of a plurality of measuring points) are arranged at intervals in the vertical scanning direction (i.e., the moving direction of the belt 13 and the photosensitive drum 28, or the direction in which the varying positional deviation can be detected). When the marks 52K-52C are formed at respective ideal positions, the intervals between adjacent marks 52K-52C become equal.

In addition, the intervals between the adjacent marks 52K-52C of the steady-deviation detection pattern P2 are greater than the intervals between the marks 51K, 51Y of the varying-deviation detection pattern P1. Furthermore, the length of the steady-deviation detection pattern P2 in the vertical scanning direction is at least equal to, preferably greater than the circumferential length of the photosensitive drum 28. More preferably, the length is equal to an integral multiple (greater than one) of the circumferential length of the photosensitive drum 28. The length of the pattern P2 may also be equal to the entire circumferential length of the belt 13.

Next, while the marks 52K-52Y pass the detection area of the pattern detection sensor 15 at respective time points, the CPU 40 measures the time points by the signal received from the sensor 15. Then, based on the measurement result, the CPU 40 detects, for each mark sets, amounts of positional deviation of the marks 52Y, 52M, 52C (other than black mark 52K) in the vertical scanning direction on the basis of the position of the black mark 52K (S203). Note that the colors other than black are hereinafter referred to as correction colors. Then, the CPU 40 calculates an average value of the positional deviation amounts of all the mark sets with respect to each correction color. Further, for each correction color, the CPU 40 calculates a value that compensates for the average value of the positional deviation amounts, and adds the calculated value to the steady-deviation correction value stored in the NVRAM 43. The CPU 40 thus updates the steady-deviation correction values (S204) and, thereafter, completes the steady-deviation detection process.

Figure 7:
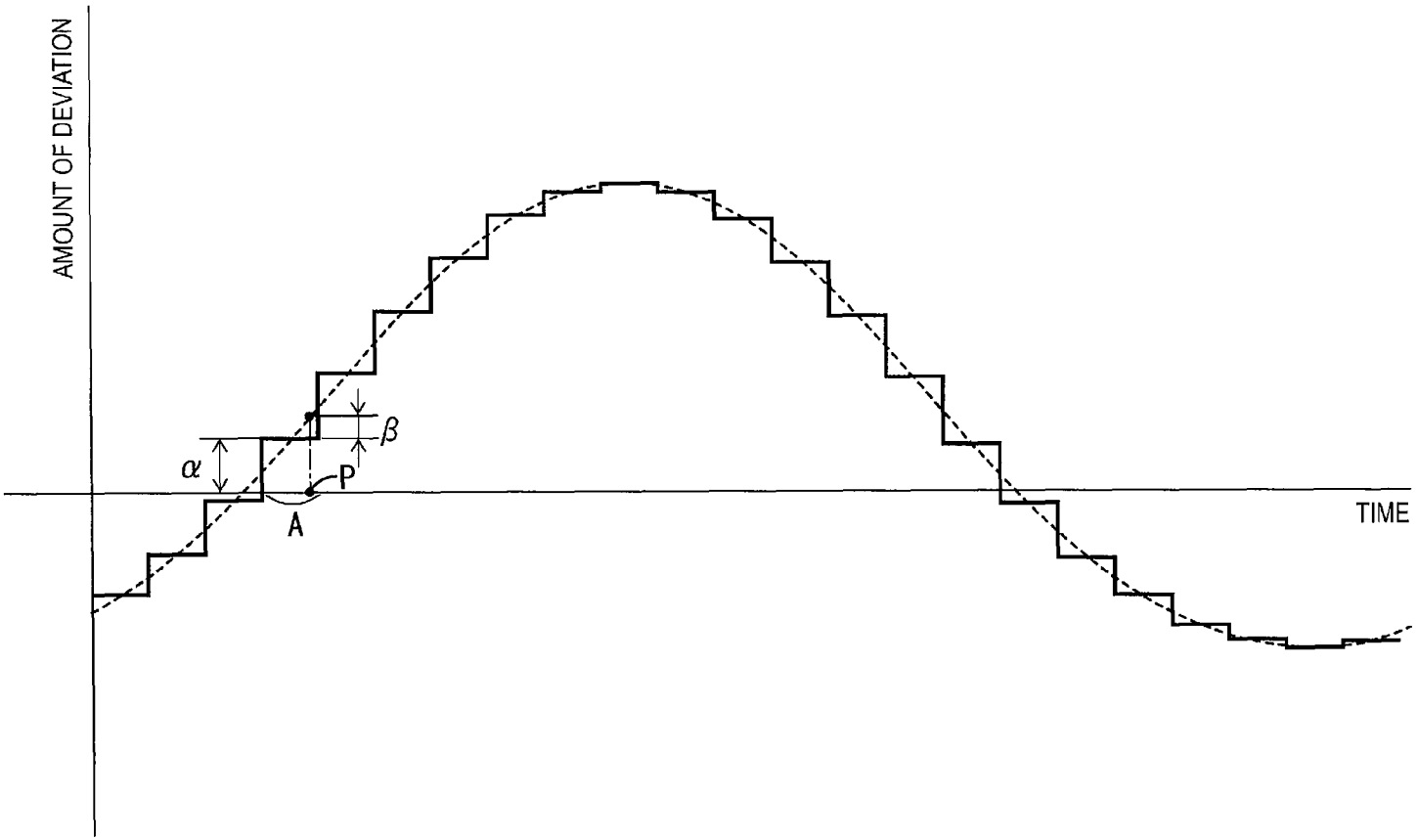
FIG. 7 is a graph illustrating a relationship between time, actual amount and detected amount of varying positional deviation in one cycle of the photosensitive drum.

FIG. 7 illustrates a relationship between time, actual amount and detected amount of varying positional deviation in one cycle of the photosensitive drum 28. The actual amount (illustrated by a dashed line) corresponds to amount of varying positional deviation of an image to be formed by one of the image forming units 20K-20C in a state where the varying-deviation correction is disabled. The detected amount (illustrated by a solid line) corresponds to amount of varying positional deviation virtually detected in the varying-deviation detection. The upper side of the vertical axis represents amount of backward deviation (relative to the moving direction of the sheet 3), while the lower side of the axis represents frontward deviation. In the varying-deviation detection, as described above, the cycle of the photosensitive drum 28 is divided into the plurality of sections, the deviation amount for each section is calculated, and the values that compensate for the deviation amounts of the respective sections are set as the varying-deviation correction values. Accordingly, the (virtually) detected amount in the varying-deviation detection varies in a stepwise fashion as illustrated in FIG. 7. For example, the detected amount in section A is $\alpha$.

Now suppose that the steady-deviation detection pattern P2 is formed in a state where the varying-deviation correction is enabled. If scanning of a scan line in the section A is started at time point P, the CPU 40 compensates the deviation by the amount $\alpha$, while the actual amount of the deviation is $\alpha+\beta$. Accordingly, at the time point P, the varying-deviation correction contains an error of amount $\beta$, which caused in the varying-deviation detection. The amounts of such errors in the varying-deviation correction may be different for each line. Therefore, the positions of the marks 52K-52C may deviate from their respective ideal positions due to the errors contained in the varying-deviation correction, and this deviation results in decreasing the accuracy in the steady-deviation detection. Note that the above-described error is a type of quantization error accompanied with such digital data processing. The varying-deviation detection and the varying-deviation correction may also contain other type of errors caused by various factors.

On the other hand, in this illustrative aspect, when forming the steady-deviation detection pattern P2, the CPU 40 disables the varying-deviation correction. That is, the positions of the marks 52K-52C may contain varying deviation; however, those are not affected by the errors contained in the varying-deviation detection or correction. During the steady-deviation detection, the CPU 40 measures the amounts of positional deviation of the marks 52Y-52C of the correction colors formed in this state and calculates the average of the measured amounts for each color, so that the varying positional deviation can be substantially eliminated from the detection result. At the same time, the result does not contain the errors caused in the varying-deviation detection or correction. Note that the steady-deviation detection pattern P2 may preferably include a large number of the marks 52K-52C, which preferably arranged evenly for each section of the cycles of the photosensitive drums 28. Thereby the influence of the varying positional deviation on the detection result can be still more reduced.

(Density-Deviation Detection Process)

Figure 8:
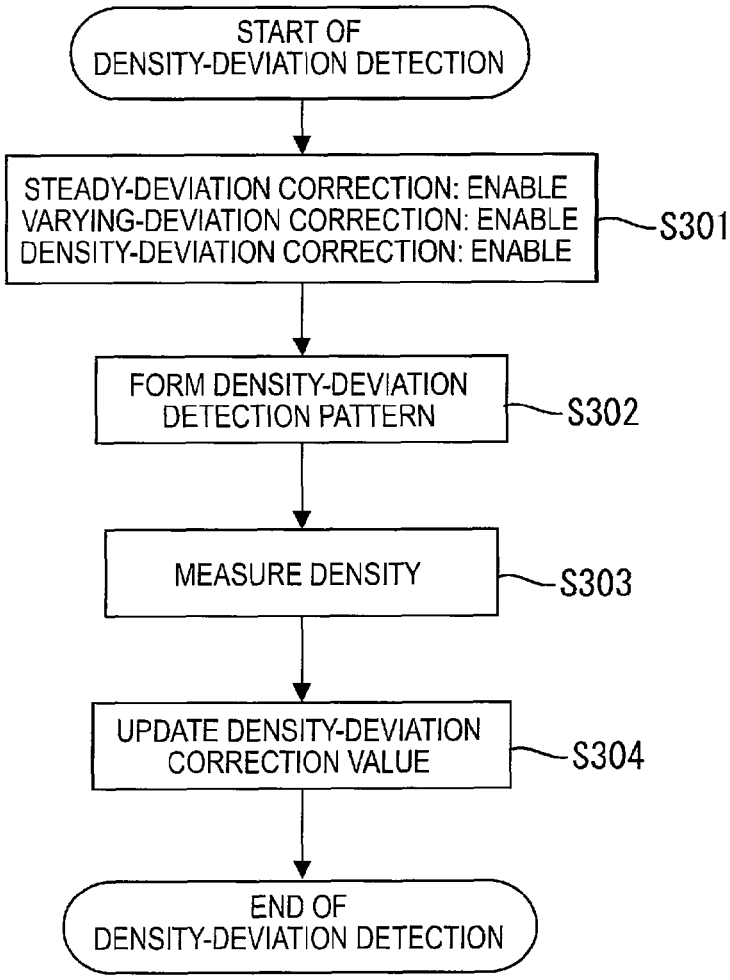
FIG. 8 is a flowchart illustrating a density-deviation detection process.

FIG. 8 is a flowchart illustrating a density-deviation detection process.

During the density-deviation detection process, the CPU 40 enables the steady-deviation correction, the varying-deviation correction, and the density-deviation correction (S301) and forms a density-deviation detection pattern (not illustrated) on the belt 13 using the image forming units 20K-20C (S302). Note that the density-deviation detection pattern includes a plurality of density marks which have different densities and colors.

In this step, the CPU 40 reads out the steady-deviation correction values, the varying-deviation correction values, and the density-deviation correction values from the NVRAM 43. Then, the CPU 40 produces image data of the density-deviation detection pattern. In producing the image data, the CPU 40 corrects the density data based on the density-deviation correction values and, further, corrects the scan start timing data based on the steady-deviation correction values and the varying-deviation correction values. Thus, the density-deviation detection pattern is formed in the state where the steady positional deviation, the varying positional deviation, and the density deviation have been corrected.

After forming the density-deviation detection pattern, the CPU 40 measures the density of each density mark using the pattern detection sensor 15 (S303). Then, the CPU 40 calculates the density deviation correction values based on the measurement result, and updates the values stored in the NVRAM 43 (S304). Thereby, desired density in images to be formed can be achieved.

Suppose that the CPU 40 forms the density-deviation detection pattern in a state where the varying-deviation correction is disabled. Then, the densities of the density marks may fluctuate due to the varying positional deviation (i.e., due to variation in the scan line intervals), and the fluctuation may deteriorate accuracy in the detection. By contrast, in this illustrative aspect, the CPU 40 enables the varying-deviation correction when forming the density-deviation detection pattern, so that the accuracy in the density-deviation detection can be ensured.

(Printing Process)

Figure 9:
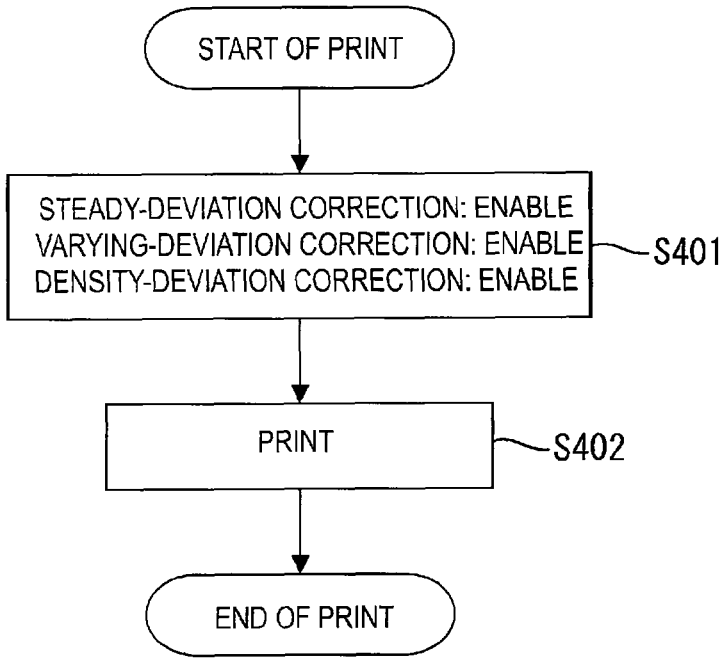
FIG. 9 is a flowchart illustrating a printing process.

FIG. 9 is a flowchart illustrating a printing process.

When receiving a print instruction issued by the external computer and the like, the CPU 40 executes the printing process as illustrated in FIG. 9. During the printing process, the CPU 40 enables the steady-deviation correction, the varying-deviation correction, and the density-deviation correction (S401) and forms a requested image on the sheet 3 using the image forming units 20K-20C (S402). Thereby, the steady positional deviation, the varying positional deviation, and the density deviation in the image can be reduced.

4. Effect of the Illustrative Aspect

In the steady-deviation detection, if the pattern is formed in the state where the varying-deviation correction is enabled, the accuracy in the steady-deviation detection may be reduced due to errors (e.g., quantization error) caused in the varying-deviation detection or correction. To prevent this, in the steady-deviation detection of this illustrative aspect, the CPU 40 forms the steady-deviation detection pattern P2 in the state where the varying positional deviation correction is disabled, measures the positional deviation amounts at a plurality of measuring points (marks 52K-52C) of the pattern P2, and detect the steady positional deviation based on the measurement. Thereby, the accuracy in the steady-deviation detection can be ensured.

In addition, the steady-deviation detection pattern P2 has a length greater than a length corresponding to the cycle of the varying positional deviation. Thereby, the influence of the varying positional deviation contained in the measurement result of the pattern P2 can be reduced. The accuracy in the steady-deviation detection can thus be ensured.

Furthermore, the steady-deviation detection pattern P2 has a length corresponding to an integral multiple (greater than one) of the cycle of the varying deviation. Thereby, the varying positional deviation contained in the measurement result can be substantially eliminated. In this way, the accuracy in the steady-deviation detection can be improved.

Furthermore, the CPU 40 forms the density-deviation detection pattern used for measuring density deviation in the state where the varying-deviation correction is enabled, so that the pattern can be formed with less color irregularities. Accordingly, by detecting the density deviation using this density-deviation detection pattern, the accuracy in the density-deviation correction can be ensured.

Furthermore, the steady-deviation detection and the varying-deviation detection are performed independently of each other by measuring the respective different patterns P1, P2. Therefore, the accuracy of each detection can be easily achieved, compared to a construction in which these detections are performed simultaneously by measuring the same pattern.

<Other Embodiments>

The present invention is not limited to the illustrative aspects described above with reference to the drawings. For example, illustrative aspects as follows are also included within the scope of the present invention, namely:

(1) In the above aspect, the present invention is illustratively adopted to a printer of a direct tandem type. However, the present invention may be adopted also to an image forming apparatus of another type such as a printer of an intermediate transfer type or an inkjet printer. Furthermore, in the above aspect, the belt is utilized as an image carrier whereon the patterns are formed. However, another member such as a photosensitive drum, a photosensitive belt, an intermediate transfer belt, an intermediate transfer drum, or a transfer drum may be utilized as the image carrier.

(2) In the above aspect, the varying positional deviation having the cycle corresponding to the rotational period of the photosensitive drum is illustratively detected and corrected. However, according to the present invention, varying positional deviation having another cycle or cycles corresponding to, for example, rotational periods of the belt drive roller and/or gear members may be detected and corrected.

(3) As described above, the length of the steady-deviation detection pattern may preferably correspond to an integral multiple of the cycle of the varying positional deviation. However, the length of the pattern can be varied to suit individual requirements. For example, the length of the pattern may be 1.5 times the length corresponding to the cycle of the varying positional deviation.

What is claimed is:

1. An image forming apparatus comprising:

an image carrier;

a plurality of forming devices configured to form an image; and a processor configured to operate as a detecting device configured to perform a steady-deviation detection and a varying-deviation detection, the steady-deviation detection being for detecting steady positional deviation of an image to be formed by the plurality of forming devices, the varying-deviation detection being for detecting varying positional deviation of the image, the varying positional deviation having a cycle; and a correcting device configured to perform a steady-deviation correction and a varying-deviation correction, and selectively enable or disable the varying-deviation correction, the steady-deviation correction being for correcting the steady positional deviation based on the result of the steady-deviation detection, the varying-deviation correction being for correcting the varying positional deviation based on the result of the varying-deviation detection, wherein:

the detecting device forms, during the steady-deviation detection, a steady-deviation detection pattern on the image carrier using the plurality of forming devices in a state where the varying deviation correction is disabled;

the steady-deviation detection pattern has a plurality of measuring points arranged in a longitudinal direction; and the detecting device, during the steady-deviation detection, measures positional deviation amount at each of the plurality of measuring points, and detects the steady positional deviation based on the measurement result.

2. The image forming apparatus according to claim 1, wherein the steady-deviation detection pattern has a length greater than a length corresponding to one cycle of the varying positional deviation.

3. The image forming apparatus according to claim 1, wherein the steady-deviation detection pattern has a length corresponding to an integral multiple of one cycle of the varying deviation, the integral multiple being greater than one.

4. The image forming apparatus according to claim 1, wherein:

the detecting device, during the varying-deviation detection, forms a varying-deviation detection pattern on the image carrier using the plurality of forming devices, and measures the varying-deviation detection pattern.

5. The image forming apparatus according to claim 1, wherein:

the detecting device is further configured to perform a density-deviation detection for detecting density deviation of the image, wherein, the detecting device, during the density-deviation detection, forms a density-deviation detection pattern on the image carrier using the plurality of forming devices in the state where the varying deviation correction is enabled and measures the density-deviation detection pattern; and the correcting device is further configured to perform a density-deviation correction for correcting density deviation of the image based on the result of the density-deviation detection.

6. The image forming apparatus according to claim 1, wherein the image carrier is a belt.

* * * * *